US005390886A

United States Patent [19]

Lawner et al.

[11] Patent Number: 5,390,886

[45] Date of Patent: Feb. 21, 1995

[54] SCUBA ACCESSORY INTERCHANGE SYSTEM

[76] Inventors: Irwin Lawner, 183-10 69th Ave., Fresh Meadows, N.Y. 11365; Michael J. Spergel, 210 Chance Dr., Oceanside, N.Y. 11572; Tod W. Lentini, 717 Park Ave., Huntington, N.Y. 11743

[21] Appl. No.: 25,871

[22] Filed: Mar. 3, 1993

Related U.S. Application Data

[63] Continuation-in-part of Ser. No. 656,210, Feb. 15, 1991, abandoned.

[51] Int. Cl.[6] ..... A47B 96/06

[52] U.S. Cl. ..... 248/224.3; 248/231

[58] Field of Search ..... 248/224.3, 221.1, 224.4, 248/219.1, 218.4, 231, 205.1; 403/378, 379, 324

[56] References Cited

U.S. PATENT DOCUMENTS

| | | | |
|---|---|---|---|
| 1,786,995 | 12/1930 | Halberstader | 248/222.1 X |
| 3,142,470 | 7/1964 | Iandiorio et al. | 248/224.3 X |
| 3,388,884 | 6/1968 | Eggler et al. | 248/224.3 X |
| 4,659,046 | 4/1987 | Parduhn | 248/231 |
| 4,699,565 | 10/1987 | Seaberg | 403/324 X |
| 4,889,306 | 12/1989 | Boucher | 248/313 |
| 5,039,052 | 8/1991 | Carafice | 248/224.3 X |

FOREIGN PATENT DOCUMENTS

| | | | |
|---|---|---|---|
| 0362814 | 8/1962 | Switzerland | 248/224.3 |

*Primary Examiner*—Ramon O. Ramirez
*Attorney, Agent, or Firm*—Michael I. Kroll

[57] ABSTRACT

An improved quick disconnect device is provided and consists of a female bracket mountable to one scuba tank and a male bracket mountable to another scuba tank. The male bracket can engage with the female bracket and be retained thereto. A mechanism is for allowing the male bracket to be disengaged from the female bracket when the mechanism is removed therefrom.

1 Claim, 3 Drawing Sheets

SCUBA ACCESSORY INTERCHANGE SYSTEM

CROSS REFERENCE TO RELATED APPLICATIONS

This patent application is a continuation-in-part of patent application Ser. No. 656,210, filed Feb.15, 1991, now abandoned.

BACKGROUND OF THE INVENTION

1. Field of the Invention

The instant invention relates generally to mounting brackets and more specifically it relates to an improved quick disconnect device for use with scuba equipment to hold two or more tanks together.

2. Description of the Prior Art

Numerous mounting brackets have been provided in prior art that are adapted to anchor two different articles together while these units may be suitable for the particular purpose to which they address, they would not be as suitable for the purposes of the present invention as heretofore described.

SUMMARY OF THE INVENTION

A primary object of the present invention is to provide an improved quick disconnect device that will overcome the shortcomings of the prior art devices and is used to firmly attach two or more air tanks used by scuba divers.

Another object is to provide an improved quick disconnect device in which a male bracket is connected to one article is retained in a female bracket connected to another article and held together by a quick release pin.

An additional object is to provide an improved quick disconnect device in which the female bracket can be connected to a vertical structure, such as the back of a boat, truck, wall, bulkhead, so as to hold one article thereto.

A further object is to provide an improved quick disconnect device that is simple and easy to use.

A still further object is to provide an improved quick disconnect device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1D is an end view similar to FIG. 1A showing the male bracket with a ninety degree bend so that the instant invention can be used to hold a barbecue on a boat or the like.

DETAILED DESCRIPTION OF THE PREFERRED EMBODIMENTS

Figure 1B:
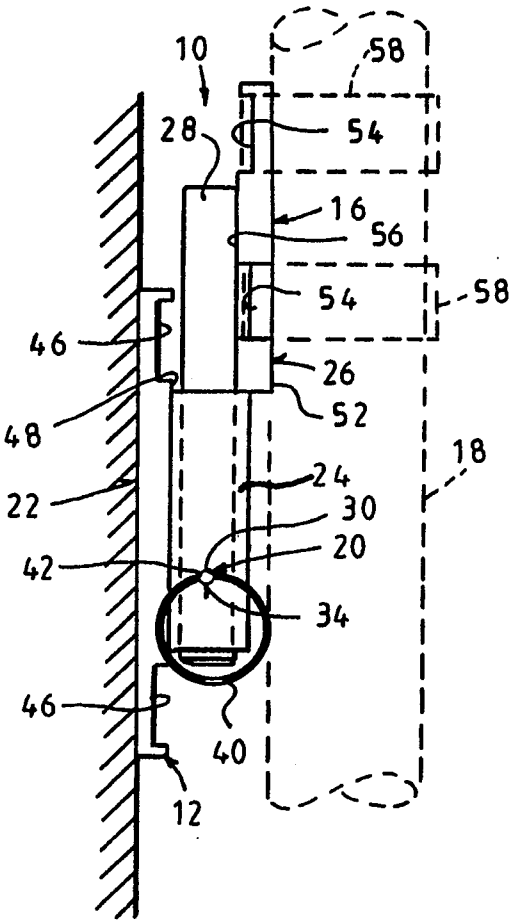
FIG. 1B is a side view similar to FIG. 1 showing the female bracket mounted to a structure.
Figure 1A:
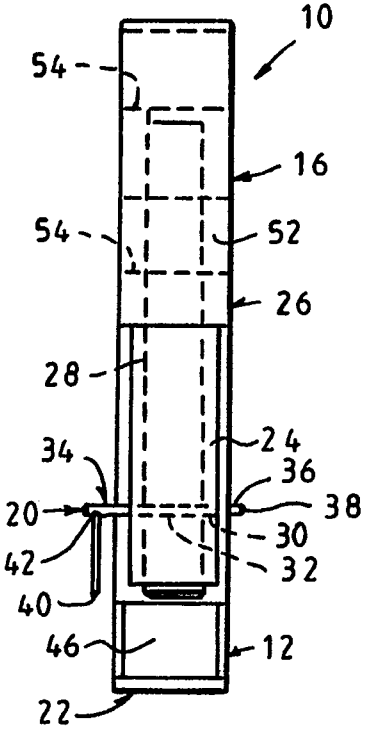
FIG. 1A is an end view of the instant invention per se.
Figure 1:
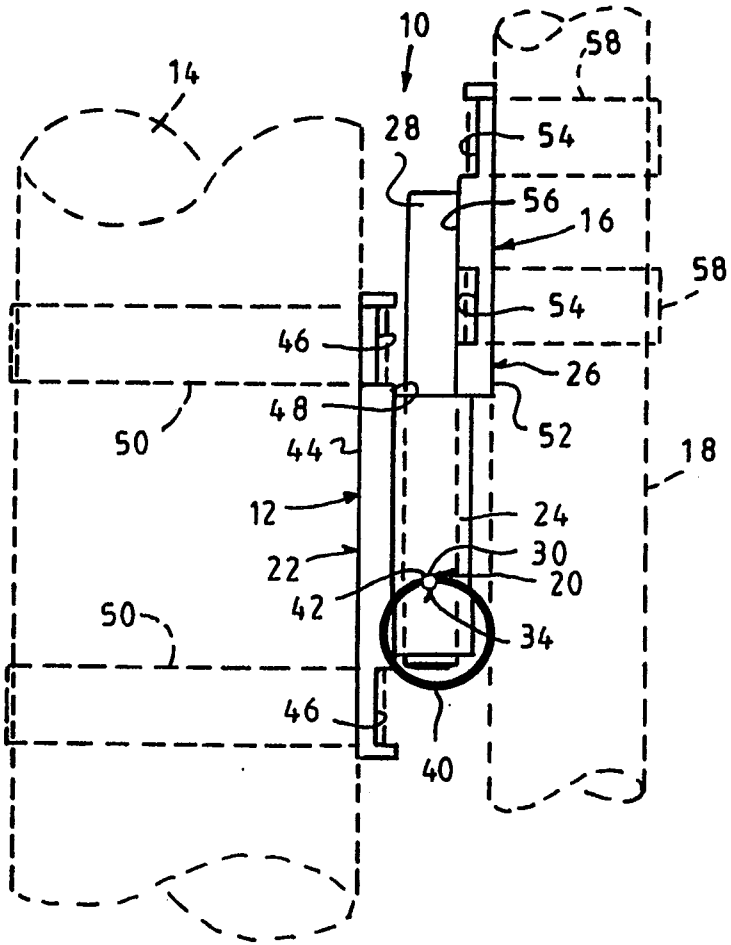
FIG. 1 is a side view of the instant invention holding two different sized articles together.

Turning now descriptively to the drawings, in which similar reference characters denote similar elements throughout the several views, the Figures illustrate an improved quick disconnect device 10 consisting of a female bracket 12 mountable to one article 14. A male bracket 16 is mountable to another article 18, whereby the male bracket 16 can engage with the female bracket 12 and be retained thereto. A mechanism 20 is for allowing the male bracket 16 to be disengaged from the female bracket 12 when the mechanism 20 is removed therefrom.

Figure 2A:
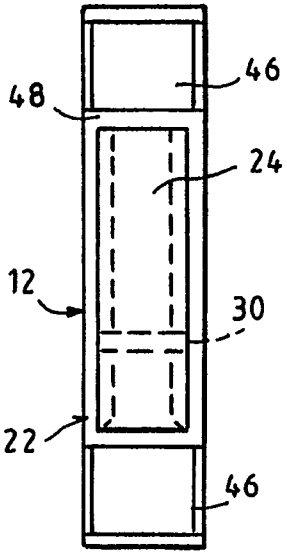
FIG. 2A is an end view of the female bracket.
Figure 2:
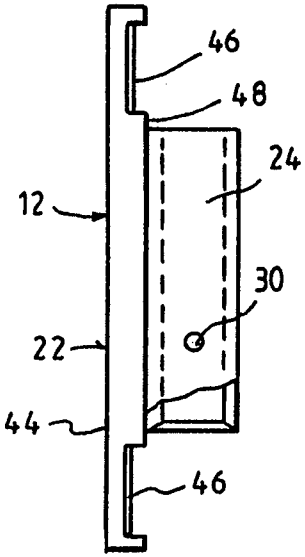
FIG. 2 is a side view of the female bracket with parts broken away and in section.
Figure 2B:
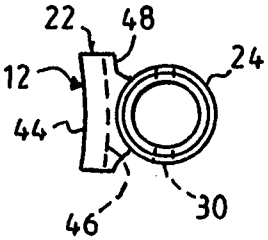
FIG. 2B is a bottom view of the female bracket.

The female bracket 12, as best seen in FIGS. 2 through 2B, includes a mounting plate 22 that is attachable to the one article 14 and a sleeve 24 affixed to the mounting plate 22.

Figure 3A:
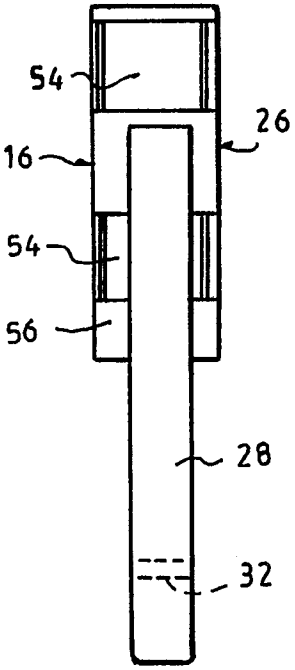
FIG. 3A is an end view of the male bracket.
Figure 3:
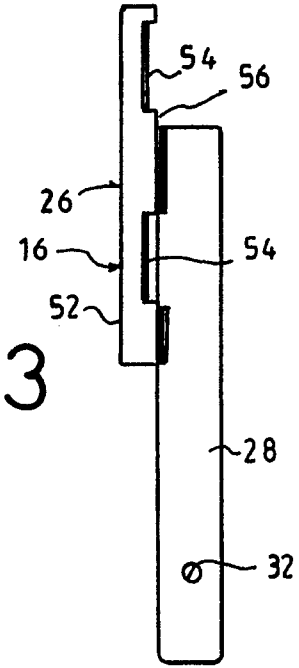
FIG. 3 is a side view of the male bracket.
Figure 3B:
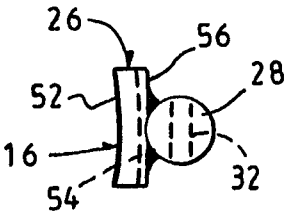
FIG. 3B is a bottom view of the male bracket.

The male bracket 16, as best seen in FIGS. 3 through 3B, includes a mounting plate 26, this is attachable to the other article 18 and a finger 28 affixed to the mounting plate 26. The finger 28 extends downwardly therefrom so that the finger 28 can be insertable into the sleeve 24 in the female bracket 12 to be retained thereto.

The disengaging mechanism 20 includes the sleeve 24 of the female bracket 12 having a transverse aperture 30 therethrough. The finger 28 of the male bracket 16 also has a transverse aperture 32 therethrough so that when the finger 28 is inserted into the sleeve 24, the transverse apertures 30 and 32 will line up with each other. A quick release pin 34 is insertable into an removable from the transverse apertures 30 and 32 in the sleeve 24 and the finger 28. In one instance when the pin 34 is inserted, the finger 28 will be retained to the sleeve 24. In another instance when the pin 34 is removed, the finger 28 can be removed from the sleeve 24.

The quick release pin 34 further includes a spring biased detent 36 transversely positioned proximate one end 38 thereof to normally keep the pin inserted and a pull ring 40 pivotally mounted to other end 42 thereof so that the pull ring 40 will help remove the pin 34.

The mounting plate 22 of the female bracket 12 has a curved back surface 44 so that the mounting plate 22 can be attached to a curved article 14, such as a scuba air tank, a gas cylinder or the like.

The mounting plate 22 of the female bracket 12 has a pair of spaced apart transverse grooves 46 on its front surface 48, so that two clamps 50 can fit into the grooves 46 to hold the mounting plate 22 to the article 14.

The mounting plate 26 of the male bracket 16 has a curved back surface 52 so that the mounting plate 26 can be attached to a curved article 18, such as a smaller scuba air tank, a smaller gas cylinder or the like.

The mounting plate 26 of the male bracket 16 has a pair of spaced apart transverse grooves 54 on its front surface 56, so that two clamps 58 can fit into the grooves 54 to hold the mounting plate 26 to the article 18.

Figure 1C:
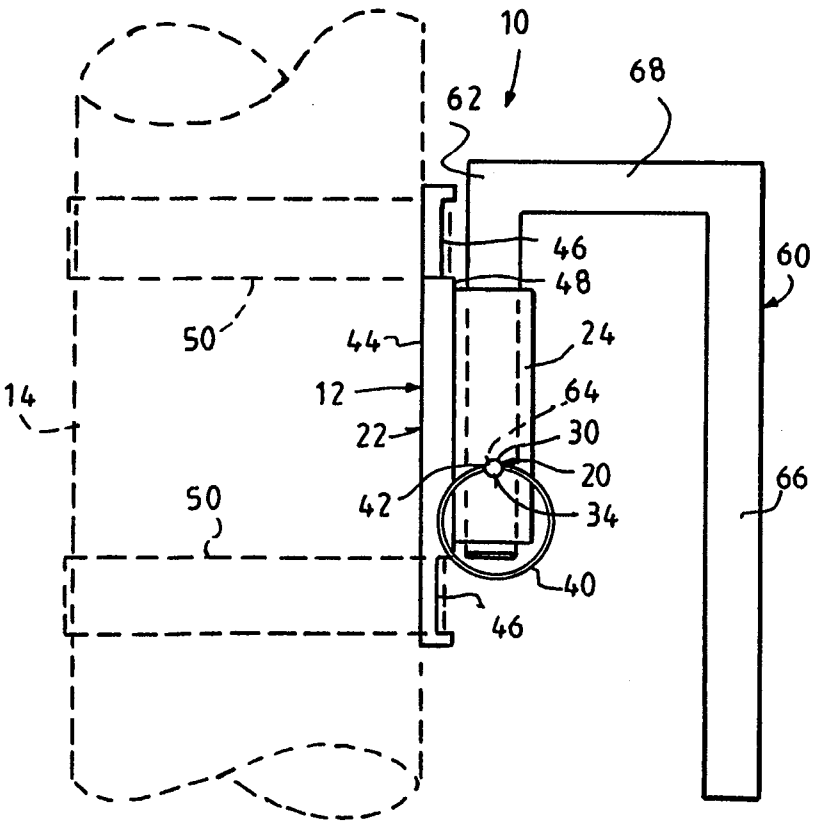
FIG. 1C is a side view similar to FIG. 1 showing a handle engaged with the female bracket so that the handle can carry the article thereby.

The improved quick disconnect device 10 as shown in FIG. 1C, further includes an inverted J-shaped handle 60 having a short arm 62 with a transverse aperture 64 therethrough, a long arm 66 and an interconnecting segment 68 between the short arm 62 and the long arm 66. The short arm can be inserted into the sleeve 24 of the female bracket 12 in place of the finger 28 of the male bracket 16. The transverse aperture 64 in the short arm 62 will line up with the transverse aperture 30 in the sleeve 24. With the quick release pin 34 inserted therein, the long arm 66 can be gripped to carry the article 14 the mounting plate 22 of the female bracket 12 is attached to.

Figure 1D:
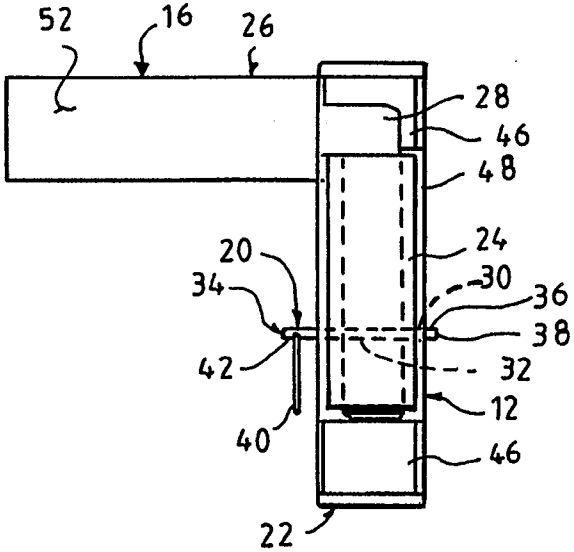

As shown in FIG. 1D, the finger 28 of the male bracket 16 is bent in a ninety degree angle so that the device 10 can be used to hold a barbecue on a boat or the like.

The female bracket 12, the male bracket 16, the release pin 24 and the J-shaped handle 60 of the improved quick disconnect device 10 can all be fabricated out of a durable metal material, such as iron, steel, aluminum or the like.

LIST OF REFERENCE NUMBERS

10 improved quick disconnect device
12 female bracket
14 article
16 male bracket
18 article
20 disengaging mechanism
22 mounting plate of 12
24 sleeve of 12
26 mounting plate of 16
28 finger of 16
30 transverse aperture in 24
32 transverse aperture in 28
34 quick release pin
36 spring biased detent
38 one end of 34
40 pull ring
42 other end of 34
44 curved back surface on 22
46 transverse groove on 22
48 front surface of 22
50 clamp
52 curved back surface on 26
54 transverse groove on 26
56 front surface of 26
58 clamp
60 inverted J-shaped handle
62 short arm of 60
64 transverse aperture in 62
66 long arm of 60
68 interconnecting segment of 60

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or 20 specific aspects of this invention.

What is claimed is new and desired to be protected by Letters Patent is set forth in the appended claims:

1. An improved quick disconnect device for scuba tanks, comprising;

a female bracket being mountable to a first scuba tank, having a first mounting plate attachable to the first scuba tank and a cylindrical sleeve affixed to said first mounting plate, wherein said first mounting plate has a curved back surface so that said first mounting plate can be firmly attached to the first scuba tank, and said first mounting plate has a pair of spaced apart transverse grooves on its front surface so that two clamps can fit into said grooves to hold said first mounting plate to the first scuba tank;

a male bracket being mountable to a second scuba tank, having a second mounting plate attachable to the second scuba tank and a projecting finger affixed to and extending downwardly from said second mounting plate, wherein said second mounting plate has a curved back surface so that said second mounting plate can be firmly attached to the second scuba tank, and said second mounting plate has a pair of spaced apart transverse grooves on its front surface so that two clamps can fit into said grooves to hold said second mounting plate to the second scuba tank;

means for attaching and detaching the first and second scuba tanks comprising;

a transverse aperture extending through said cylindrical sleeve perpendicular to a longitudinal axis of said sleeve;

a cross bore extending through said projecting finger perpendicular to a longitudinal axis of said finger;

quick release pin means suited for insertion into said transverse apertures, wherein attachment is achieved when said finger of said male bracket is inserted into said sleeve of said female bracket until said transverse aperture and said cross bore are aligned to form a through passage, and said removable quick release pin means is inserted into said through passage so as to lock said finger in said sleeve, and wherein detachment is achieved when said quick release pin means is removed from said through passage and said finger of said male bracket is removed from said sleeve of said female bracket.

* * * * *